United States Patent [19]

Hahn et al.

[11] Patent Number: 4,773,453

[45] Date of Patent: Sep. 27, 1988

[54] PROCEDURE FOR FILLING INSULATING GLASS UNITS

[75] Inventors: Wolfgang Hahn, Puchheim/Bhf.; Siegfried Gruber, Munich, both of Fed. Rep. of Germany

[73] Assignee: DCL Glas-Consult GmbH, Munchen, Fed. Rep. of Germany

[21] Appl. No.: 38,007

[22] Filed: Apr. 14, 1987

[51] Int. Cl.[4] ..... B65B 31/00

[52] U.S. Cl. ..... 141/7; 141/59; 141/65

[58] Field of Search ..... 141/1-12, 141/59, 128, 65, 83, 66

[56] References Cited

U.S. PATENT DOCUMENTS 2,875,792 3/1959 Moyer ..... 141/4

3,683,974 8/1972 Stewart et al. ..... 141/4

*Primary Examiner*—Henry J. Recla

*Assistant Examiner*—Ernest G. Cusick

*Attorney, Agent, or Firm*—Leonard Bloom

[57] ABSTRACT

Process for the filling of the interior space of insulating glass units whereby the air-filling is replaced by a heavier gas. An optimum is set between an as-short-as-possible filling time and as-small-as-possible turbulent mixing losses through the appropriate control of the filling and evacuation rate.

17 Claims, No Drawings

PROCEDURE FOR FILLING INSULATING GLASS UNITS

FIELD OF THE INVENTION

The invention concerns the area of insulating glass units. These are arrangements most often used for window glazing, which include at least two parallel glass panes which are bound together gas-tight with a spacing frame. The initially air-filled space between the two glass panes is most often filled with heavier gases to achieve better sound and heat insulation. For this reason, the air found in the interior space must be evacuated and the heavier gas must be introduced.

BACKGROUND OF THE INVENTION

During the construction of such insulating glass units, units of varying size are filled with heavy gas one after the other using the same filling apparatus. The costs of the filling depend, on the one hand, upon the total time required for the complete filling with heavy gas and, on the other hand, upon the total quantity of heavy gas required for the filling. Losses of heavy gas can especially occur in that during the introduction of the heavy gas into the initially, after construction of the unit, air-filled interior space, turbulent mixing between the heavy gas and the air takes place which becomes more pronounced the more quickly the heavy gas is introduced. The portion of the introduced heavy gas mixed in this manner with the air must now also be as fully as possible replaced with unmixed heavy gas as otherwise an insufficient sound and heat insulation will result.

A procedure for filling the interior space of an insulating glass unit with nitrogen is known from U.S. Pat. No. 2,756,467, in which dried nitrogen is introduced through the bottom end and the air is evactuated from the top end. Simultaneously, the pressure in the interior space of the insulating glass unit is monitored and the filling and evacuation rate is regulated so that there is constantly a small negative pressure in the interior space. The problems of the filling rate as well as of the turbulent mixing of the filling gas with the air are here neither mentioned nor solved.

From EP No. 0 046 847, which goes back to the same inventors as the present invention, an automation of the filling procedure is proposed through the control of the filling and/or evacuation rate depending upon the measured pressure. Because of the surety of the automatic control, the filling rate can be raised without danger of excess pressure in the interior space and breakage of the insulating glass unit so far, that a decrease of the filling time of at least 30% is achieved. Also this known procedure is only concerned with the prevention of glass breakage during a faster filling and not with the problem of losses introduced with the turbulent mixing.

SUMMARY OF THE INVENTION

Through the present invention, an automatic procedure is presented for the filling of the interior space of insulating glass units independent of their sizes through which an optimum compromise is achieved between the two mutually conflicting demands, on the one hand, to keep the filling time as short as possible and, on the other hand, to keep as-small-as-possible the losses introduced through the turbulent mixing and at the same time to achieve as complete as possible an exchange of the air with the heavy filling gas.

The gases predominantly used today for the filling of insulating glass units are all heavier than air. Thus, if one were to introduce these gases extremely slowly and carefully at the bottom end of the interior space, then there would result a relatively stable horizontal separation boundary between the heavier gas, collecting on the bottom, and the overlying lighter air. The losses resulting from the turbulent mixing at this separation boundary could thus be held to an absolute minimum. The filling time would thereby, to be sure, be extremely long which would sharply increase the costs of the filling despite the avoidance of the turbulent mixing losses.

Were one, on the other hand, to increase the filling rate without regard to turbulent mixings, even then no minimum filling time dependent only upon the capacities of the filling and evacuation apparatus could be achieved as the created turbulence would be so great that the introduction of the heavy gas and the evacuation of the turbulence-mixed air-heavy gas mixture would have to be continued for such a long time so as to be unacceptable for modern production circumstances before a relatively air-free filling of the interior space would be achieved. Here, also, the costs of the filling would become very high. Experiments have shown besides that by such a procedure a concentration by weight of over 85% can be achieved only after a very long filling time whereas 90% is required as the minimum.

DESCRIPTION OF PREFERRED EMBODIMENTS

By the invented procedure, a small excess pressure in the interior space is initially produced, in a small time interval, about a fraction of a second, through the introduction of the heavy gas at the bottom end in a pulsed fashion, which naturally is chosen in its magnitude so that neither glass breakage nor destruction of the seal in the insulating glass unit can occur. The excess pressure, measured in this short time interval, is given to the electronic computer which calculates the volume of the interior space from the magnitude of the excess pressure. Subsequently, heavy gas is introduced at a relatively low rate through the bottom end and, at the same time, air is evacuated at a corresponding rate from the top end. These rates are automatically sent from the computer to the filling and evacuation apparatus. This low filling rate is now maintained until a specified filling level in the interior space is reached. The time required to reach this previously defined filling level naturally depends upon the previously ascertained volume of the interior space and is therefrom appropriately set by the computer. Naturally, the filling level reached in this set time differs a bit depending upon the shape of the insulating glass unit which can range from square to rectangular and can also have non-square shapes. The time of the slow filling until the achievement of the defined filling level is chosen in such a way, so that the filling level reached by the heavy gas is also sufficient during the filling of insulating glass units of extreme shape, so that during the subsequent increase of the filling rate no significant increase in the turbulent mixing is supported. Until this point in time, the filling rate is held so low so that the turbulent mixing of the heavy gas and the air remains below a specified minimum value, and at the end of this time required to reach the average filling level, the filling rate and the evacuation rate are simultaneously increased stepwise in such a way that again, considering the filling level now reached, the turbulent mixing remains below the specified minimum value. The magnitude of the stepwise increase in the filling and evacuation rate adjusts itself likewise according to the size of the ascertained volume since by a very small volume a large increase in the rate is naturally not sensible. Basically, a sliding increase of the filling rate depending upon the ascertained volume is also possible.

By very large volumes to be filled, the filling and evacuation rates, if necessary, can be similarly increased stepwise upon reaching a second average filling level of the heavy gas and, by very large volumes, upon reaching further average filling levels.

The evacuation rate is throughout controlled by the computer not depending upon the filling rate but rather depending upon the pressure measured in the interior space, which is kept within specified limits whereby damage to the insulating glass unit can neither be caused by excess pressure nor by negative pressure.

As soon as towards the end of gas replacement in the interior space, the portion of the heavier gas rises up in the mixture of air and heavier gas evacuated by the evacuation apparatus, the evacuation ability of the evacuation apparatus declines. The evacuation ability can now be increased so far until the capacity of the evacuation apparatus is exhausted. With very high filling or introducing rates, the situation can now be very rapidly reached in which a required further increase in the evacuation rate is no longer possible. Therewith, the pressure in the interior space rapidly increases. As soon as the computer senses this increase in the measured pressure, it correspondingly decreases the introducing rate so that no damaging excess pressure can occur in the interior space despite a no longer achievable increase of the evacuation rate.

Concurrently with the evacuating procedure the evacuated air, or towards the end of gas replacement the evacuated mixture of air and the heavier gas will be monitored. A disappearing of air in the mixture indicates a full replacement of air with the heavier gas in the interior space. As soon as such disappearing of air in the evacuated mixture is ascertained by the monitoring apparatus which is measuring for example the thermal conductivity and/or the density of the evacuated gas mixture, the introduction of the heavier gas into the interior space and the evacuating of the mixture which consists only of the heavier gas towards the end of replacement will be terminated simultaneously. For this purpose the computer will receive a stop signal by the monitoring apparatus, and thereupon it will give a terminating signal to the introducing and evacuating apparatuses.

For the evaluation of the invented procedure, one must bear in mind that it is normally carried out with the help of a production line in which are placed in rapid succession insulating glass units of differing shapes and differing sizes according to the order entries. One could naturally think of determining the form of the interior volume through mechanical measurement and of feeding it to the computer. By the desired extraordinarily high throughput speeds of such a production line this would, however, lead to unbearable delays in the procedure. The ascertainment of the volume of the interior space through rapid excess pressure determination, according to the invention, therefore, presents a method making possible a rapid execution of the procedure, which in practice leads to superior results with regard to a quick filling with the least possible loss of heavy gas.

What is claimed is:

1. A process for replacing air disposed in an air tight interior space having an upper end and lower end, with a heavier gas without substantial mixing thereof, said process comprising:

introducing by pulsating the heavier gas into the lower end of the interior space producing therein an excess pressure having a magnitude;

analyzing the magnitude of the excess pressure and determining therefrom the volume of the interior space, at least one filling level of the interior space, the rate of subsequent introductions of the heavier gas into the interior space and the rate of subsequent evacuations of air from the interior space;

introducing the heavier gas into the lower end of the interior space at a first rate in response to the analysis until a first filling level is reached and, simultaneously therewith;

evacuating air from the upper end of the interior space at the said first rate in response to the analysis until the first filling level is reached;

said simultaneous introducing and evacuating forming a relatively stable horizontal separation boundary between the heavier gas and the air, said separation boundary having less than a minimum value of a mixture of air and heavier gas;

increasing, simultaneously, the introduction of the heavier gas and the evacuation of air to a second rate, and subsequently the evacuation of the mixture or air and the heavier gas of the separation boundary to a second rate in response to the analysis upon reaching the first filling level;

monitoring the evacuated mixture of air and the heavier gas of the separation boundary, wherein disappearing of air in the mixture indicates full replacement of air with the heavier gas in the interior space; and terminating, simultaneously, the introducing of the heavier gas into the interior space and the evacuating of the heavier gas from the interior space in response to a monitored disappearing of air in the evacuated mixture.

2. The process of claim 1, further comprised of:

decreasing, simultaneously, the rate of introduction of the heavier gas and the rate of evacuation of the first gas in response to a monitored disappearing of air in the evacuated mixture.

3. The process of claim 1, further comprised of:

a plurality of filling levels being determined from the analysis of the magnitude of the excess pressure; and increasing, simultaneously, the rate of introduction of the heavier gas and the rate of evacuation of air to subsequent increased rates in response to the analysis upon reaching each respective filling level.

4. The process of claim 3, wherein the rate of introduction and evacuation is increased in a stepwise fashion.

5. A process for replacing air disposed in an air tight interior space having an upper end and a lower end, with a heavier gas without substantial mixing thereof, said process comprising:

pulsating the heavier gas into the lower end of the interior space producing therein an excess pressure having a magnitude;

analyzing the magnitude of the excess pressure and determining therefrom the volume of the interior space, a plurality of filling levels of the interior space, the rate of subsequent introductions of the heavier gas into the interior space and the rate of subsequent evacuations of air from the interior space;

introducing the heavier gas into the lower end of the interior space at a first rate in response to the analysis until a first filling level is reached and, simultaneously therewith;

evacuating air from the upper end of the interior space at the said first rate in response to the analysis until the first filling level is reached;

said simultaneous introducing and evacuating forming a relatively stable horizontal separation boundary between the heavier gas and the air, said separation boundary having less than a minimum value of a mixture of air and heavier gas;

increasing, simultaneously, the introduction of the heavier gas and the evacuation of air to a second rate in response to the analysis upon reaching the first filling level;

increasing, simultaneously, the rate of introduction of the heavier gas and the rate of evacuation of air and subsequently the evacuation of the mixture of air and the heavier gas of the separation boundary to subsequent increased rates in response to the analysis upon reaching each respective subsequent filling level;

monitoring the evacuated mixture of air and the heavier gas of the separation boundary, wherein disappearing of air in the mixture indicates full replacement of air with the heavier gas in the interior space;

decreasing, simultaneously, the rate of the introduction of the heavier gas and the rate of the evacuation of air in response to a monitored disappearing of air; and terminating, simultaneously, the introducing of the heavier gas into the interior space and the evacuating of the heavier gas from the interior space in response to a monitored disappearing of air in the evacuated mixture.

6. A process for replacing air disposed in an air tight interior space of an insulating glass unit having an air tight spacing frame and at least two substantially parallel glass panes disposed in said frame, said panes defining therebetween the air tight interior space having an upper end and a lower end, with a heavier gas without substantial mixing thereof, said process comprising:

introducing by pulsating the heavier gas into the lower end of the interior space producing therein an excess pressure having a magnitude;

analyzing the magnitude of the excess pressure and determining therefrom the volume of the interior space, at least one filling level of the interior space, the rate of subsequent introductions of the heavier gas into the interior space and the rate of subsequent evacuations of air from the interior space;

introducing the heavier gas into the lower end of the interior space at a first rate in response to the analysis until a first filling level is reached and, simultaneously therewith;

evacuating air from the upper end of the interior space at the said first rate in response to the analysis until the first filling level is reached;

said simultaneous introducing and evacuating forming a relatively stable horizontal separation boundary between the heavier gas and the air, said separation boundary having less than a minimum value of a mixture of air and heavier gas;

increasing, simultaneously, the introduction of the heavier gas and the evacuation of air to a second rate, and subsequently the evacuation of the mixture of air and heavier gas of the separation boundary to a second rate in response to the analysis upon reaching the first filling level;

monitoring the evacuated mixture of air and the heavier gas of the separation boundary, wherein disappearing of air in the mixture indicates full replacement of air with the heavier gas in the interior space; and terminating, simultaneously, the introducing of the heavier gas into the interior space and the evacuating of the heavier gas from the interior space in response to a monitored disappearing of air in the evacuated mixture.

7. The process of claim 6, further comprised of:

decreasing, simultaneously, the rate of introduction of the heavier gas and the rate of evacuation of the first gas in response to a monitored disappearing of air in the evacuated mixture.

8. The process of claim 6, further comprised of:

a plurality of filling levels being determined from the analysis of the magnitude of the excess pressure; and increasing, simultaneously, the rate of introduction of the heavier gas and the rate of evacuation of air to subsequent increased rates in response to the analysis upon reaching each respective filling level.

9. The process of claim 8, wherein the rate of introduction and evacuation is increased in a stepwise fashion.

10. A process for replacing a first gas disposed in an air tight interior space having an outlet and an inlet, with a second gas without substantial mixing thereof, said process comprising:

introducing by pulsating the second gas through the inlet and into the interior space producing therein an excess pressure having a magnitude;

analyzing the magnitude of the excess pressure and determining therefrom the volume of the interior space, at least one filling level of the interior space, the rate of subsequent introductions of the second gas through the inlet and into the interior space and the rate of subsequent evacuations of the first gas through the outlet and from the interior space;

introducing the second gas through the inlet and into the interior space at a first rate in response to the analysis until a first filing level is reached and, simultaneously therewith;

evacuating the first gas through the outlet and from the interior space at the said first rate in response to the analysis until the first filling level is reached;

said simultaneous introducing and evacuating forming a relatively stable horizontal separation boundary between the first gas and the second gas, said separation boundary having less than a minimum value of a mixture of first and second gases;

increasing, simultaneously, the introduction of the second gas and the evacuation of the first gas to a second rate, and subsequently the evacuation of the mixture of the first and second gases of the separation boundary to a second rate is response to the analysis upon reaching the first filling level;

monitoring the evacuated mixture of the separation boundary, wherein disappearing of the first gas in the mixture indicates full replacement of the first gas with the second gas in the interior space; and terminating, simultaneously, the introducing of the second gas into the interior space and the evacuating of the second gas from the interior space in response to a monitored disappearing of air in the evacuated mixture.

11. The process of claim 10, further comprised of:

decreasing, simultaneously, the rate of introduction of the second gas and the rate of evacuation of the first gas in response to a monitored disappearing of air in the evacuated mixture.

12. The process of claim 10, further comprised of:

a plurality of filling levels being determined from the analysis of the magnitude of the excess pressure; and increasing, simultaneously, the rate of introduction of the second gas and the rate of evacuation of the first gas to subsequent increased rates in response to the analysis upon reaching each respective filling level.

13. The process of claim 12, wherein the rate of introduction and evacuation is increased in a stepwise fashion.

14. Process for the filling of an interior space of an insulating glass unit having at least two parallel glass panes, disposed being bound together gas-tight in a spacing frame, wherein the interior space has air therein being replaced with a heavier gas, comprised of:

introducing the heavier gas at or near the bottom of the insulating glass unit at a specified rate;

measuring the pressure of a desired location in the interior space;

calculating the volume of the interior space by means of an electronic computer on the basis of a pressure increase of the interior space being measured in a very short time interval; and further calculating the introduction rate by the computer of an initial value, on the basis of a time interval dependent upon the calculated volume, so that the turbulent mixing of the filling gas with the air present in the interior space remains beneath a specified minimum value;

at the same time evacuating air or a gas air mixture at or near the top end of the interior space of the insulating glass unit air at a rate set by the computer depending upon the previously measured pressure and at a rate corresponding to the filling rate; and increasing by the computer the introduction and evacuation rates at the end of the volume-dependent time interval to a volume-dependent second value.

15. The process of claim 14, characterized in that the volume-dependent time interval corresponds to the achievement of a specified average filling level of the interior space with the gas being introduced.

16. The process of claim 15, characterized in that the filling rate and the evacuation rate, respectively, are increased stepwise by the computer to a second and, if necessary, further values after reaching specified average filling levels.

17. The process of claim 14, characterized in that the computer decreases the filling rate upon an increase of the measured pressure simultaneously with a further increase of the evacuation rate no longer being possible.

* * * * *